US007430981B2

(12) United States Patent
Malcore et al.

(10) Patent No.: US 7,430,981 B2
(45) Date of Patent: Oct. 7, 2008

(54) WALK-THROUGH WINDSHIELD

(75) Inventors: Terry G. Malcore, Coleman, WI (US); Curt Fifield, Oconto Falls, WI (US); Jeff Green, Porterfield, WI (US)

(73) Assignee: KCS International, Oconto, WI (US)

( * ) Notice: Subject to any disclaimer, the term of this patent is extended or adjusted under 35 U.S.C. 154(b) by 0 days.

(21) Appl. No.: 11/625,628

(22) Filed: Jan. 22, 2007

(65) Prior Publication Data

US 2008/0173229 A1 Jul. 24, 2008

(51) Int. Cl.
*B63B 17/00* (2006.01)

(52) U.S. Cl. ..... 114/361

(58) Field of Classification Search ..... 114/361; 296/216.04, 86, 87, 216.01, 216.05, 220.01
See application file for complete search history.

(56) References Cited

U.S. PATENT DOCUMENTS 1,596,995 A * 8/1926 Pollard ..... 296/148
2,508,804 A * 5/1950 Schwindt ..... 108/93
3,438,073 A * 4/1969 Brown ..... 114/361
5,309,860 A * 5/1994 Shearer ..... 114/361
7,401,568 B2 * 7/2008 Debasto ..... 114/361

OTHER PUBLICATIONS

Photographs of Formula Boats 45 Yacht from www.formulaboats.com/models/1082237-gallery.aspx, undated and admitted as prior art as of the date of filing of the present application.

* cited by examiner

*Primary Examiner*—Sherman Basinger
(74) *Attorney, Agent, or Firm*—Alan R. Stewart; Godfrey & Kahn, S.C.

(57) ABSTRACT

A hardtop for a boat including a windshield with an movable portion and a roof with a movable cover. The windshield includes an opening when the movable portion is in an open position and the roof includes a opening extending rearward from a front edge when the cover is in an open position. The opening in the windshield and the roof are generally aligned to define a pass-through. The forward edge of the opening portion of the roof is displaced rearward from the front edge of the roof when open and may be generally aligned with the front edge of the roof when closed. A boat including a hardtop with an opening windshield and roof.

19 Claims, 8 Drawing Sheets

WALK-THROUGH WINDSHIELD

BACKGROUND

The present disclosure relates generally to hardtops for boats.

In many powerboats, design considerations have lead to efforts to maximize cockpit and/or cabin space for a particular length, width or size class of boat. Often, the cockpit or cabin sides may extend essentially to the gunwales of the boat and make passage about the cockpit and cabin to the foredeck of the boat difficult and potentially hazardous. In many cases, simply increasing the beam does not provide any additional side deck space, as the internal volume maximization considerations would simply push the cockpit and cabin sides to the maximum available width.

One method of providing an alternative to these narrow or non-existent side decks for accessing the foredeck has been to provide an opening or movable portion of the front windscreen or windshield. However, this has been a less-than optimal solution when the boat has been fitted with a fixed hardtop connected with or in close proximity with the top of the front windshield. At least one short-coming of this approach is that for some boats, a person would be required to stoop very low to pass through the windshield and beneath the hardtop. Many persons may not be physically able to perform the necessary contortions to use the windshield passage, or such a movement may be undesirable for other persons.

Improvements to the present manner of permitting movement through the front windshield of a boat are desirable.

SUMMARY

A hardtop for a power boat includes a windshield and roof The windshield has an opening portion and the roof has an opening in a front edge. The opening portion of the windshield and the opening in the roof cooperate to define walk-through between the cockpit and the foredeck of the boat. The opening in the roof may include a movable cover that can be sealed against a top edge of the movable portion of the windshield when the cover and the opening portion of the windshield are both closed.

A boat including a windshield and roof cooperating to define a closable opening between the cockpit and the foredeck of the boat.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows:

FIG. 6 is a front perspective view of the hardtop of FIG. 3, with windshield and roof openings forming a walk-through.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
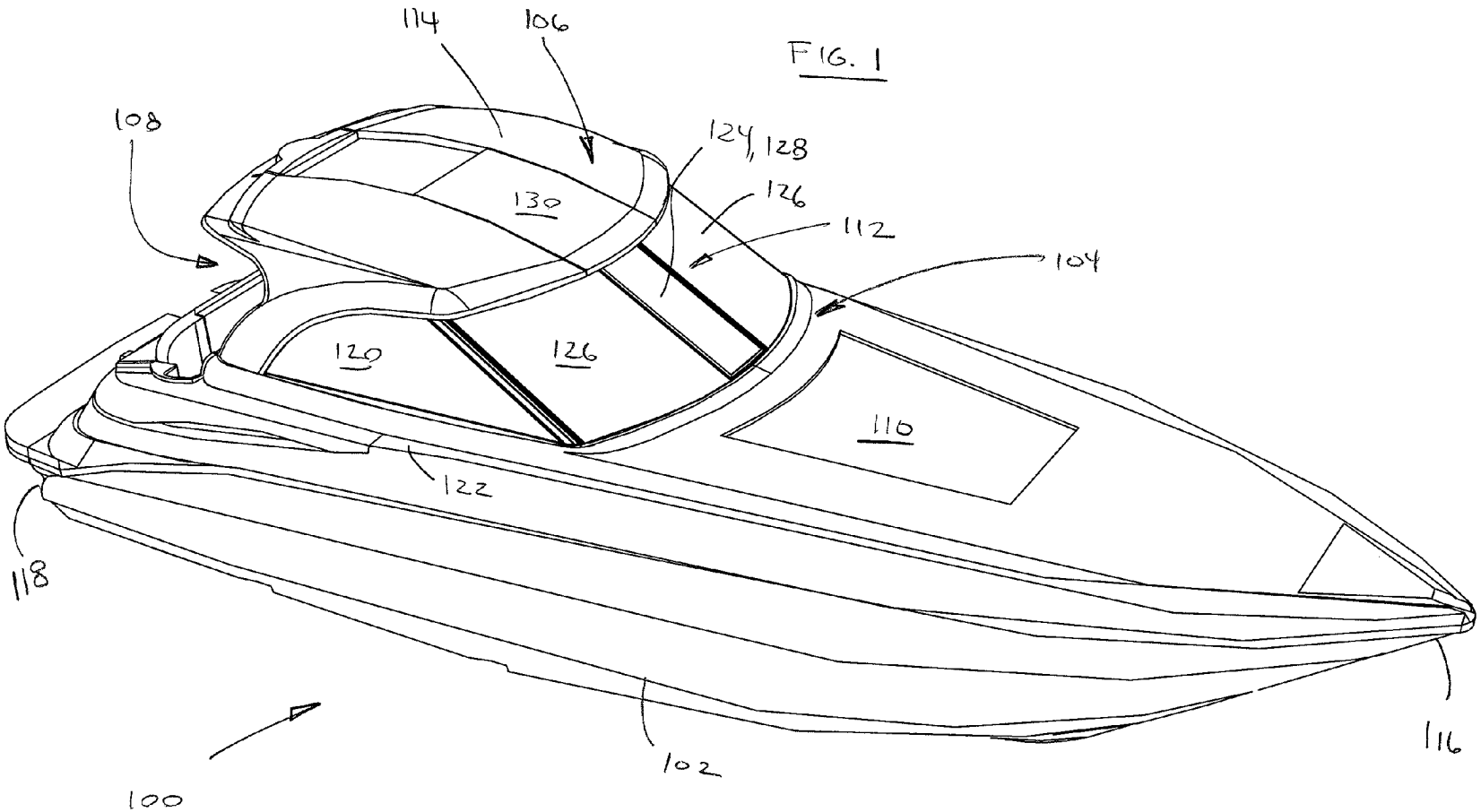
FIG. 1 is a perspective view of a powerboat with a front windshield and roof according to the present disclosure.

FIG. 1 illustrates a power boat 100 with a hull 102, a deck 104, and a hardtop 106 at least partially enclosing a forward portion of a cockpit 108 (cockpit 108 is positioned behind and underneath hardtop 106). A foredeck 110 is positioned forward of a windshield 112 that forms part of hardtop 106. Hardtop 106 includes a fixed or rigid roof 114 and may also include sides 120 to help enclose cockpit 108. Boat 100 defines a bow 116 and a stern 118.

As shown in FIG. 1, boat 100 includes only minimal side decks 122 for a person to move between cockpit 108 and foredeck 110 along sides 120 of hardtop 106. Such a passage would likely rely upon hand and foot rails (not shown) to provide security of movement and in foul seas such movement may not be feasible even with safeguards such as handholds. Boat 100 includes an opening 128 in windshield 112 that is closed by a movable portion 124 flanked on either side by fixed portions 126. Opening movable portion 124 allows a person to pass through windshield 112 from cockpit 108 to foredeck 110 without using side decks 122. For boats in some size ranges, and based on the size of the windshield, opening 128 may provide enough headroom for a normal sized person to pass easily through. A person with any sort of mobility-impairment might not be able to stoop low enough to exit the cockpit toward the foredeck.

Figure 2:
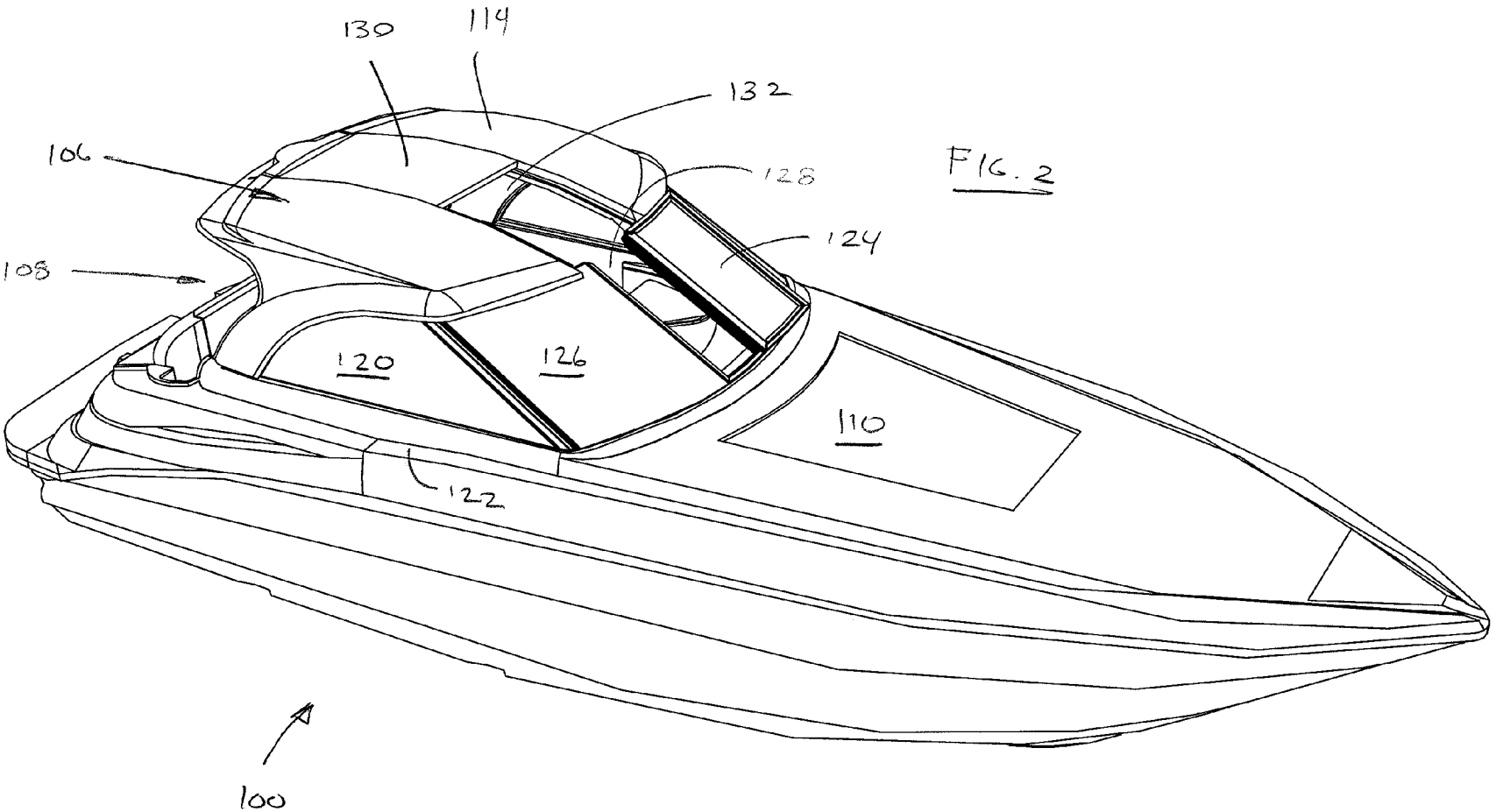
FIG. 2 is a perspective view of the powerboat of FIG. 1, with a portion of the front windshield opened and an opening in the roof.

Referring now also to FIG. 2, roof 114 includes a movable portion or cover 130 that may be moved back from a closed position of FIG. 1 to an open position of FIG. 2, revealing a recess or opening 132. Opening 132 of roof 114 is generally aligned with opening 128 of windshield 112 to provide a substantially unobstructed space for movement from cockpit 108 to foredeck 110. Movable portion 124 of windshield 112 may be hingedly mounted on one side to one of the fixed portions 126. This hinged mounting may allow movable portion 124 to swing open from a closed position, as shown in FIG. 1, and be laid back over at least part of the fixed portion 126, defining an open position, as shown in FIG. 2. Cover 130 may be slidably mounted to roof 114, and movement of cover 130 between the open and closed positions may be made by sliding.

Figure 3:
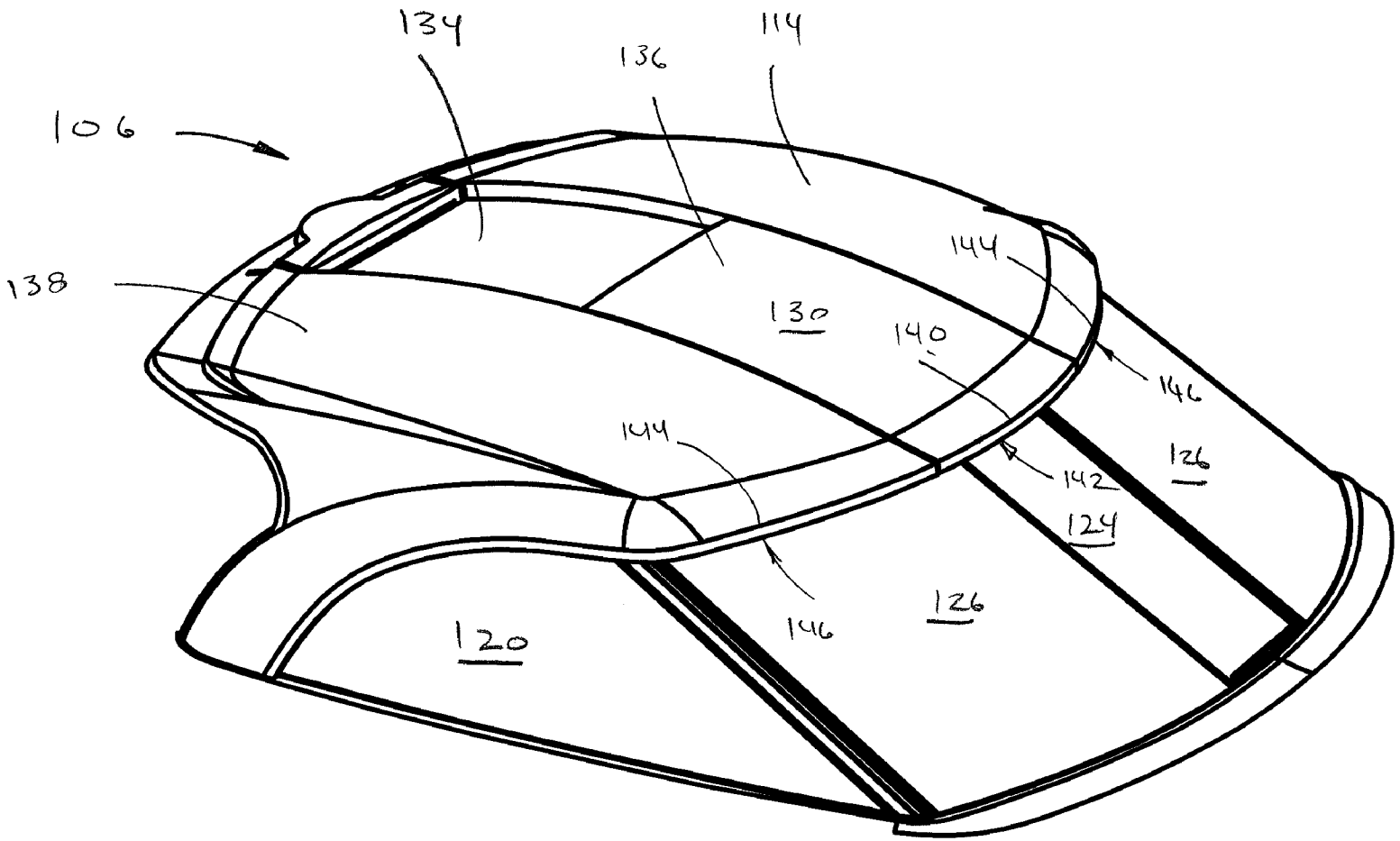
FIG. 3 is a perspective view of a hardtop for use with a boat according to the present disclosure.
Figure 4:
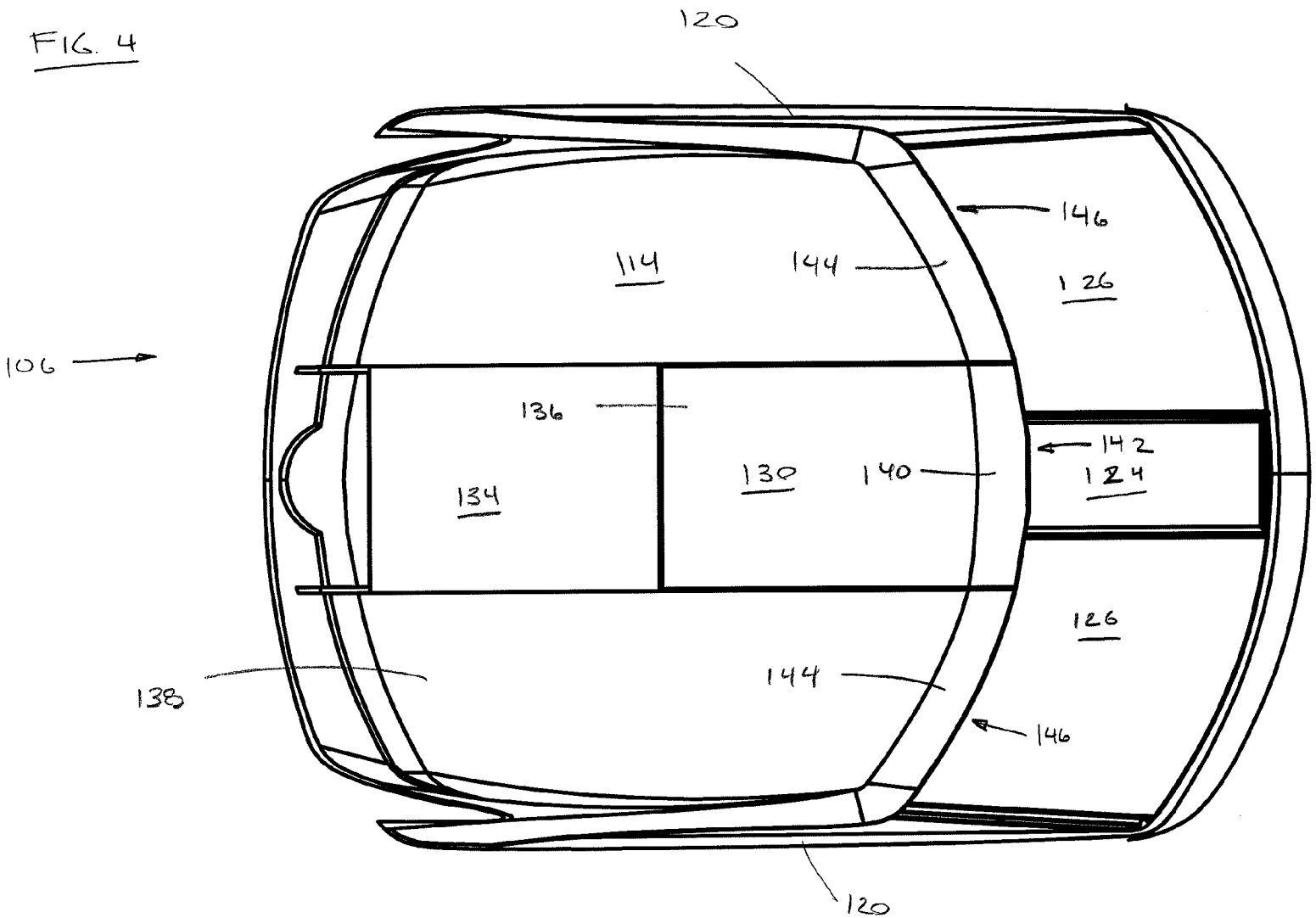
FIG. 4 is a top view of the hardtop of FIG. 3.
Figure 5:
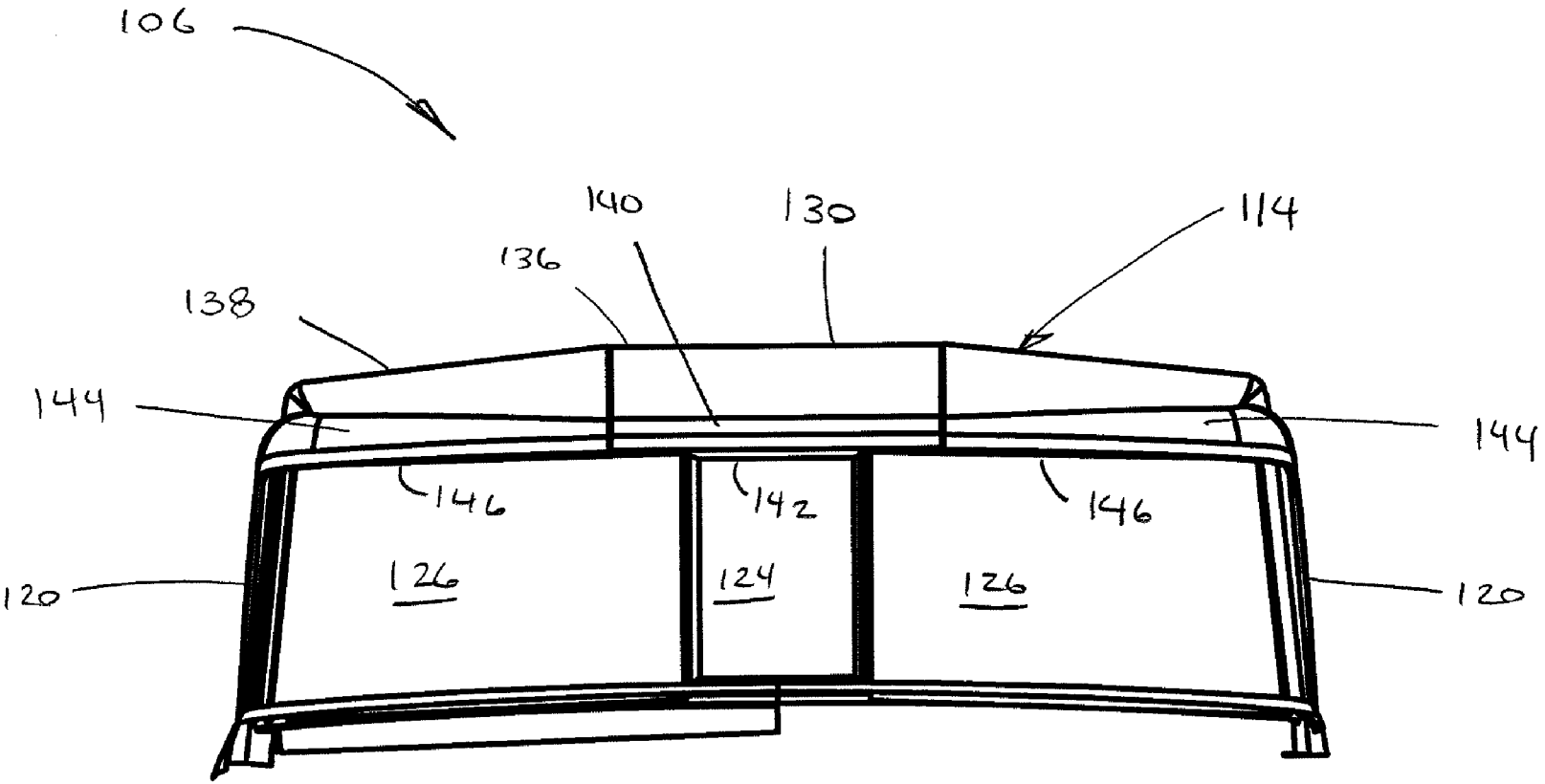
FIG. 5 is a front view of the hardtop of FIG. 3.

Referring now to FIGS. 3 to 5, hardtop 106 is shown with movable portion 124 and cover 130 in the closed position. Roof 114 may include a recess 134 within which cover 130 may be moved between the open and closed positions. Recess 134 may permit an upper surface 136 of cover 130 to be generally flush with an upper surface 138 of roof 114. Such a flush mounting may provide a more aesthetically appealing image but does not impact the functional characteristics of the movable cover. Cover 130 includes a forward edge 140 that is adjacent a top edge 142 of movable portion 124 when both are in the closed position. In addition, roof 114 includes a front edge 144 that may be generally aligned with forward edge 140 when cover 130 is in the closed position. Fixed portions 126 of windshield 112 include a top edge which are adjacent to front edges 144.

It may be preferable that top edges of windshield 112 engage roof 114 in some fashion to provide a seal against entry of water, such as spray or rain. However, the present disclosure does not require that such a seal be present. The top edges may be positioned in close proximity to the roof but not sealed, permitting air flow into the covered cockpit. In such an arrangement, it may be preferable that the top edges be positioned behind the front edges and forward edge to prevent direct entry of rain or spray from above.

Top edge 142 is preferably not fixedly attached to cover 130, permitting free movement of movable portion 124 and cover 130 between the open and closed positions. A releasable attachment may be used to hold the two movable pieces to each other in the closed position within the scope of the present disclosure.

As can be seen in FIGS. 3 to 5, in the closed position, front edges 144 and forward edge 140 are generally in alignment with each other. The appearance of this arrangement may such that in the closed position, hardtop 106 appears to have a solid front edge. From a distance, this front edge may appear to be unbroken, although the breaks between the cover 130 and roof 114 become apparent at a closer viewing point. Aesthetically, the present disclosure may maintain a consistent look with a fixed roof in the closed position.

Figure 6:
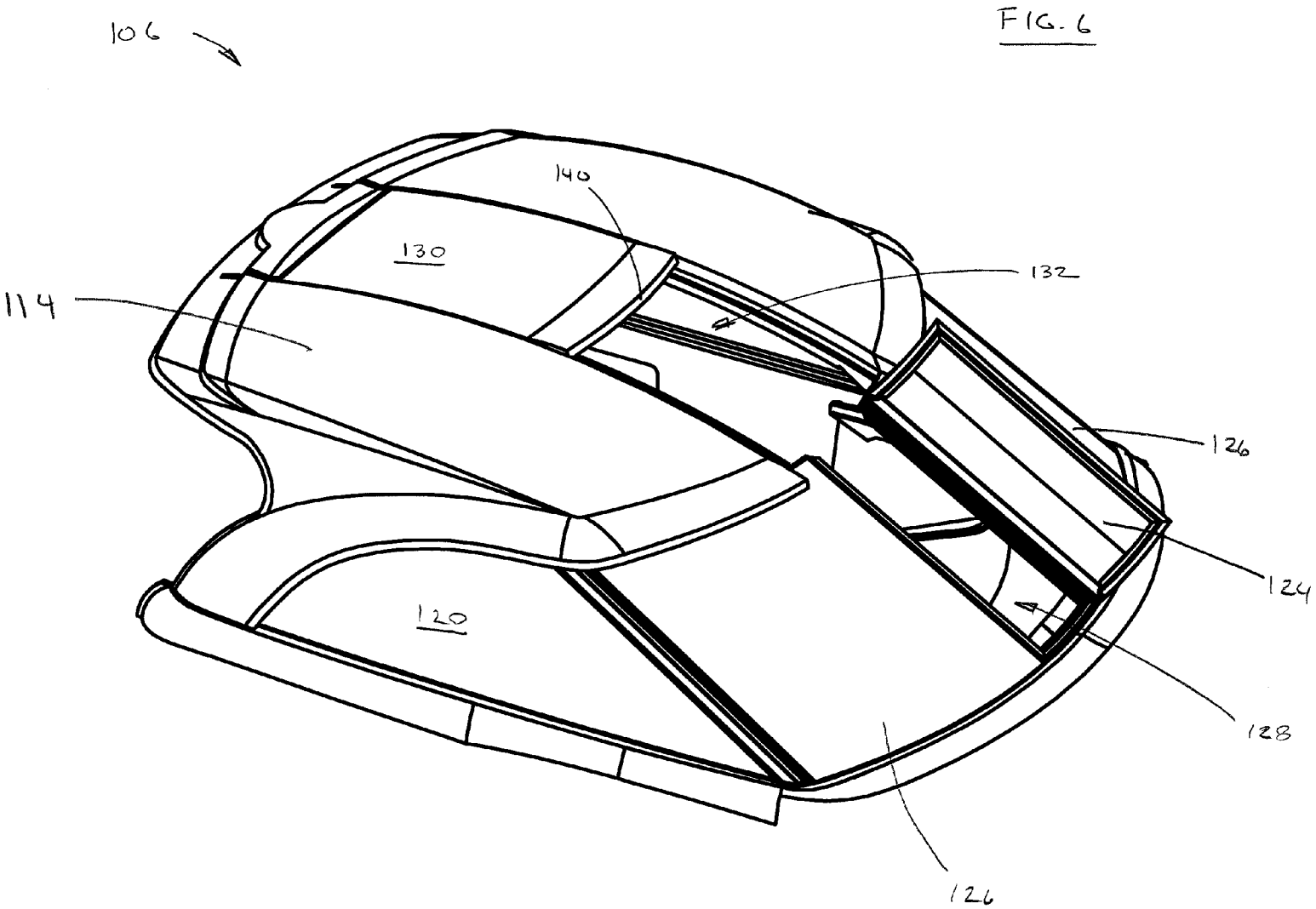
Figure 7:
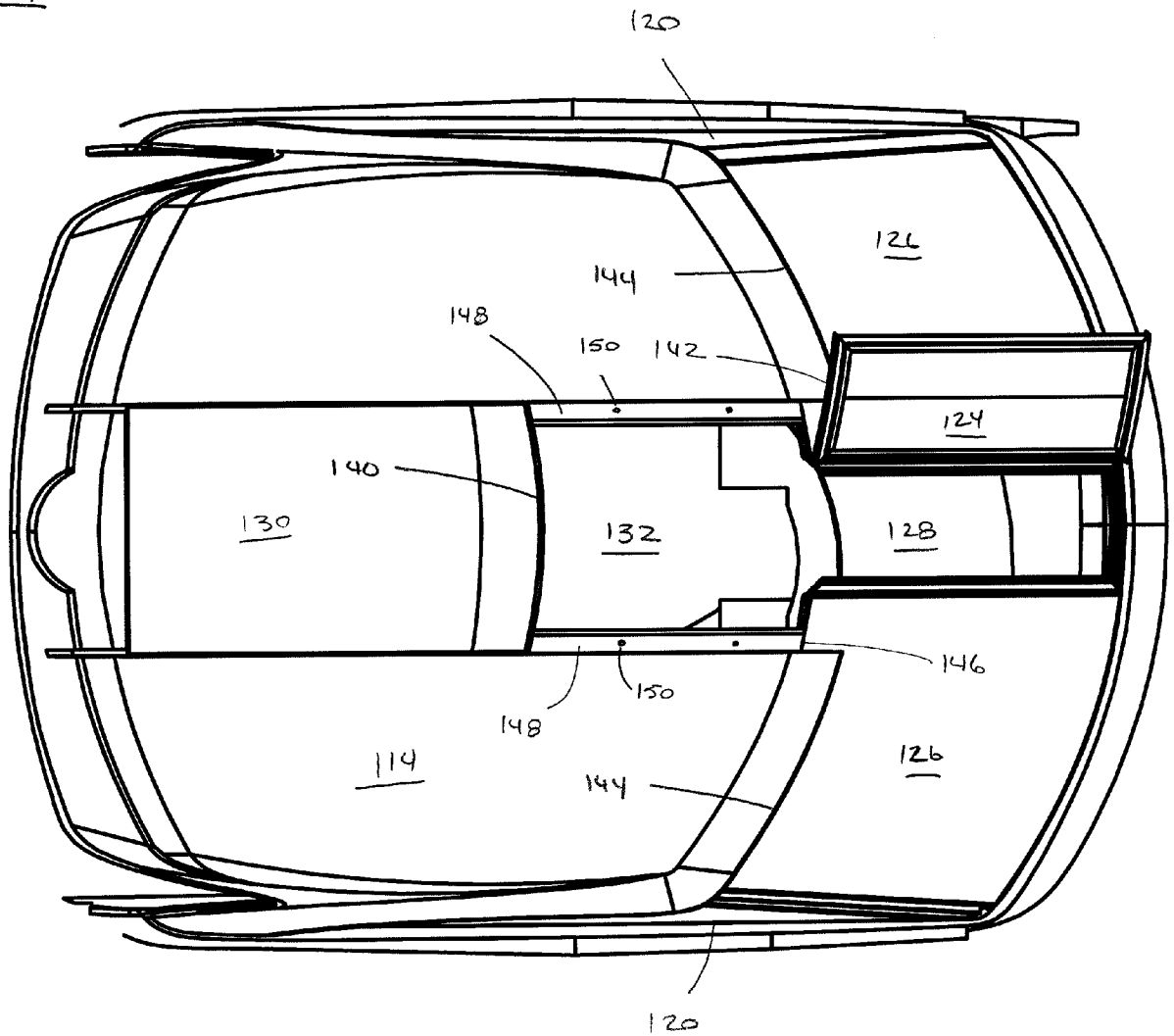
FIG. 7 is a top view of the hardtop of FIG. 6.
Figure 8:
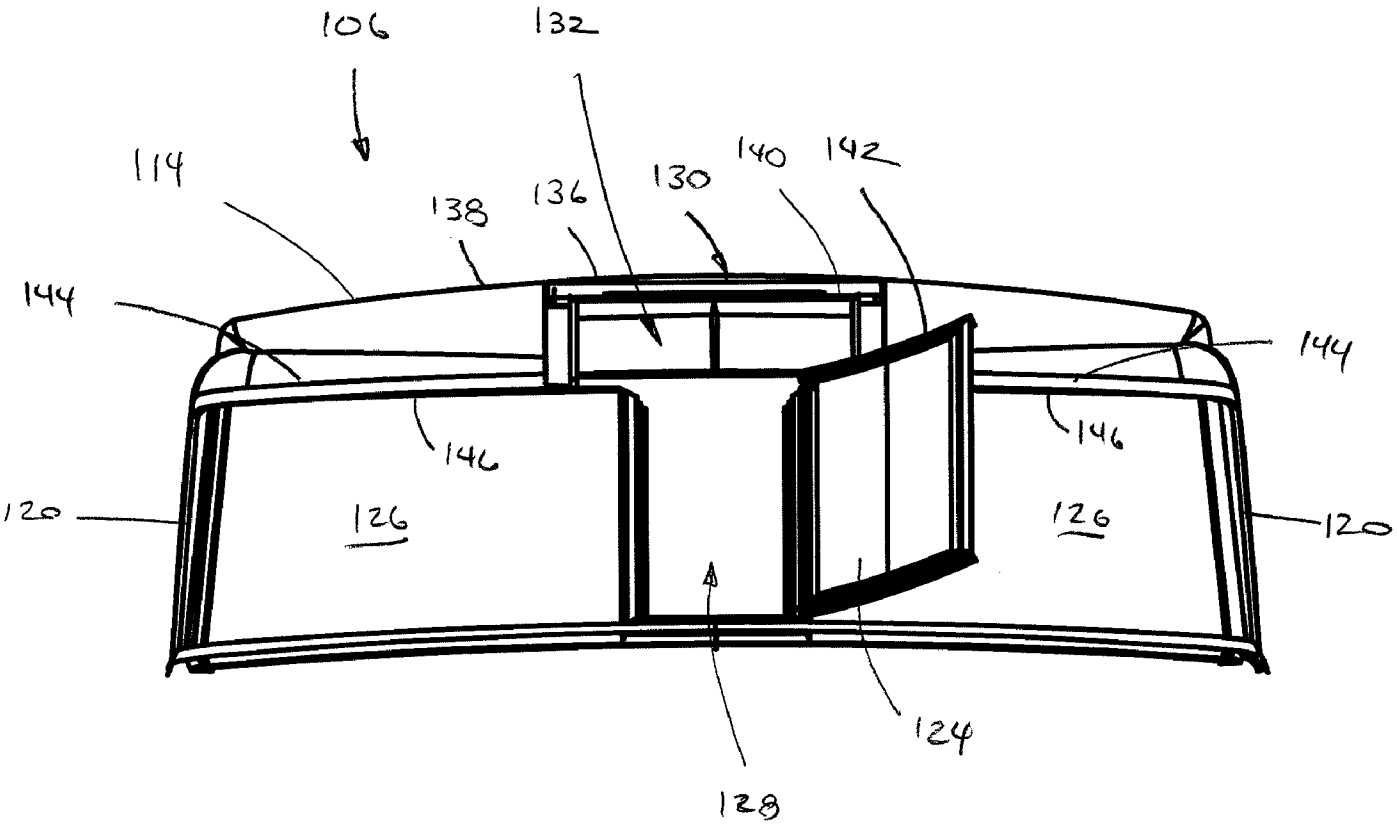
FIG. 8 is a front view of the hardtop of FIG. 6.

Referring now to FIGS. 6 to 8, hardtop 106 is shown with cover 130 and movable portion 124 in the open positions. Opening 128 through windshield 112 and opening 132 in roof 114 are generally aligned with each other to create a pass-through between cockpit 108 and foredeck 110. Opening 132 creates a gap on front edge 144 of roof 114, with forward edge 144 of cover 130 being displaced rearward from the closed position shown in FIGS. 3 to 5, where edges 140 and 144 were generally aligned. With both elements 124 and 130 in the open position, the pass-through extends continuously upward from a lower edge of windshield 112 past front edges 144 to displaced forward edge 140 of cover 130. This expanse of opening permits a person to pass-through windshield 112 from the cockpit with minimal restriction.

Conventional approaches to a windshield pass-through maintained a front edge of the roof of the hardtop across width of the windshield. In the open position of conventional hardtops with opening windshield and movable roof covers, the front edge of the roof prevented or restricted movement of a person between the cockpit and the foredeck. Hardtop 106 removes this obstacle from the pass-through and provides a more open passage.

In FIGS. 2 and 6 to 8, cover 130 is shown in a fully open position, at its point of greatest displacement rearward from front edges 144. It is anticipated that a track system may be included in rails 148 formed on either side of opening 132, permitting cover 130 to be slidably mounted within opening 132 and recess 134. It is anticipated that one or a plurality of intermediate positions of cover 132 may be defined by use of detents 150 along rails 148. Such detents may be ball detents, where application of force may be sufficient to overcome the detent and permit movement of cover 130. Alternatively, the detents may be more substantial in nature, such as pin detents, requiring displacement of an engaging pin to permit movement between the open, closed and/or intermediate positions. These intermediate positions may permit cover 130 to be opened for airflow through cockpit 108 even if windshield 112 is fully closed, or if fully opening the pass-through is unwanted or unnecessary.

The hardtop of the present disclosure is illustrated in conjunction with a power boat on FIGS. 1 and 2. However, it is anticipated that the present disclosure may be adapted for use with auxiliary powered craft as well, such as sailboats. The primary characteristic of a boat to which the present disclosure may be adapted is having a windshield and roof combination through which a relatively unobstructed passage is desired. A hardtop according to the present disclosure may cover or enclose a cockpit, a seating area or any other portion of a deck where shelter is desired. Passage through the windshield and roof may be for accessing a foredeck, a middeck or any other area of the deck that may be positioned forward of the windshield.

Cover 130 is shown as a slidably mounted cover but it is not intended that the present disclosure be limited to such a cover. A completely removable cover, a retractable cover, or a hinged, folding or collapsible cover, etc, are also within the scope of the present disclosure, providing the a gap is formed in the front edge of the roof to permit movement through the windshield and roof together. Similarly, movable portion 124 is shown hingedly mounted to windshield 112, but it not intended that the present disclosure be limited to such a mounted arrangement. Movable portion 124 may be slidably mounted to be displaced out of opening 128. Movable portion 124 may be removably mounted in the opening. Portions of movable portion 124 may be hinged separately, allowing all or a portion of opening 128 to be opened for airflow or pass-through.

The present disclosure may be used with watercraft having sufficiently wide side decks for safe passage around sides 120 of hardtop 106, to provide another, perhaps more convenient passage along the length of the vessel.

What is claimed is:

1. A hardtop for a boat, the hardtop comprising:

a fixed rigid roof with a front edge and an opening extending rearward from the front edge;

a front windshield including a top edge, the top edge adjacent to the front edge of the roof, the windshield further including at least one movable portion with a fixed portion on either side of the movable portion, the movable portion movable between a closed position where the fixed portions and the movable portion define a generally continuous windshield and an open position where a walk-through is defined through the windshield between the fixed portions;

the walk-through of the windshield and the opening of the roof cooperating to define a continuous passage through the hardtop.

2. The hardtop of claim 1, further comprising a cover mounted within the opening of the roof, the cover movable between a closed position covering the opening and an open position.

3. The hardtop of claim 2, the cover further comprising a forward edge, the forward edge adjacent to the top edge of the windshield in the closed position.

4. The hardtop of claim 3, wherein the forward edge of the cover in the closed position is generally lined up with the front edge of the roof.

5. The hardtop of claim 2, wherein the cover is slidably mounted in the opening of the roof and may be selectively moved between the open and closed positions.

6. The hardtop of claim 5, wherein the slidable mounting of the cover includes a plurality of detent positions where the cover may be selectively held between the open and closed positions.

7. The hardtop of claim 2, wherein the top edge of the fixed portions of the windshield are sealed with respect to the front edge of the roof, and the forward edge of the cover and the top edge of the moveable portion of the windshield form a seal when both are in the closed positions.

8. The hardtop of claim 2, wherein the roof defines an upper surface and the cover defines an upper surface, and the upper surfaces are generally flush with each other when the cover is in the closed position.

9. The hardtop of claim 1, wherein the movable portion of the windshield is hingedly mounted to one of the fixed portions and swings between the open and closed positions about the hinged mounting.

10. The hardtop of claim 9, wherein the movable portion in the open position swings at least partially in front of the fixed portion to which the movable portion is mounted.

11. The hardtop of claim 1, wherein the movable portion of the windshield is generally flush with the fixed portions of the windshield when the movable portion is in the closed position.

12. A boat comprising:

a deck including a cockpit and a foredeck positioned forward of the cockpit;

a windshield extending upward from the deck, the windshield positioned between the cockpit and the foredeck at a forward end of the cockpit and having a top edge;

a roof positioned above the cockpit, the roof having a forward edge positioned adjacent to the top edge of the windshield;

the windshield including a movable portion extending generally from the deck to the top edge and a fixed portion, the movable portion movable between an open position allowing movement through an opening of the windshield between the cockpit and the foredeck, and a closed position;

the roof including an opening extending rearward from the front edge and defining a gap in the front edge, the gap generally aligned with the movable portion of the windshield; and, a cover movable mounted in the opening of the roof and movable between a closed position with a forward edge generally aligned with the front edge of the roof and an open position with the forward edge displaced rearward from the front edge of the roof;

wherein with the movable portion of the windshield in the open position and the cover in the open position, the opening of the windshield and the opening of the roof cooperate to form a continuous opening between the cockpit and the foredeck.

13. The boat of claim 12, wherein the movable portion of the windshield is hingedly mounted to the fixed portion of the windshield.

14. The boat of claim 12, the windshield further comprising a fixed portion on either side of the movable portion and the movable portion hingedly mounted to one of the fixed portions.

15. The boat of claim 12, wherein the cover is slidably mounted in the opening and slidable between the open and closed positions.

16. The boat of claim 15, wherein the slide mounting of the cover includes detents for positioning the cover in at least one intermediate position between the open and closed positions.

17. The boat of claim 12, wherein the top edge of the fixed portions of the windshield and the front edge of the roof on either side of the opening are sealed to each other and the forward edge of the cover and the top edge of the movable portion of the windshield form a seal with each other when both are in the closed position.

18. The boat of claim 12, wherein the movable portion of the windshield and the fixed portion of the windshield are generally flush with each other when the movable portion is in the closed position.

19. The boat of claim 12, wherein the roof defines an upper surface and the cover defines an upper surface, and the upper surfaces are generally flush with each other when the cover is in the closed position.

* * * * *